US008556204B2

(12) United States Patent
Kao

(10) Patent No.: US 8,556,204 B2
(45) Date of Patent: Oct. 15, 2013

(54) CURTAIN CONTROL DEVICE

(75) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 258 days.

(21) Appl. No.: 13/092,294

(22) Filed: Apr. 22, 2011

(65) Prior Publication Data

US 2012/0266413 A1 Oct. 25, 2012

(51) Int. Cl.
*B65H 23/06* (2006.01)

(52) U.S. Cl.
USPC ..... 242/422.2; 242/381

(58) Field of Classification Search
USPC ..... 242/381, 422.2
See application file for complete search history.

(56) References Cited

U.S. PATENT DOCUMENTS

| | | | | |
|---|---|---|---|---|
| 6,529,323 | B2 * | 3/2003 | Okumura | 359/461 |
| 2002/0048083 | A1 * | 4/2002 | Okumura | 359/461 |
| 2013/0037225 | A1 * | 2/2013 | Huang | 160/313 |

* cited by examiner

*Primary Examiner* — Sang Kim
(74) *Attorney, Agent, or Firm* — Rosenberg, Klein & Lee

(57) ABSTRACT

A curtain control device has a stroke setting device and a damper respectively assembled at both ends of a curtain spindle rod. A torsion element is further assembled on the curtain spindle rod. A curtain spindle sleeve is invaginated on the outside of the curtain spindle rod, the stroke setting device and the damper. The curtain spindle sleeve is assembled with the combination of the curtain spindle rod and the damper, and then a curtain fabric is assembled on the outside of the curtain spindle sleeve. In this manner, the opening range of the curtain fabric roll is controlled by the stoke setting device, and the roll-up speed of each part of the curtain fabric is slowed down by the damper so as to reduce effectively the noise produced by the quick actuation of each part and the defective rate.

8 Claims, 13 Drawing Sheets

CURTAIN CONTROL DEVICE

BACKGROUND OF THE INVENTION

1. Field of the Invention

The present invention relates to a curtain control device, particularly to a curtain control device enabling the setting of the opening range of the curtain fabric and effective slow-down of the roll-up speed of each part of the curtain, so as to reduce the noise produced by the quick actuation of each part and the defective rate.

2. Brief Description of Prior Art

Referring to Japanese Patent Gazette No. 3691372 entitled as "Roll-up Curtain Speed Reduction Device", the device has a transverse mounting frame fixed on upper edge of the window, a winding rod provided within the transverse mounting frame, a curtain fabric rolled up on the winding rod, and a stroke setting device assembled with the winding rod. When user wants to adjust the range of rolling or unrolling of the curtain fabric, the curtain fabric is pulled down so as to drive the winding rod to rotate. At the same time, the rotor of the stroke setting device assembled with the winding rod is rotated in synchronized manner, and a positioning member provided in the groove of the rotor moves along the groove of the rotor. When user pull the curtain fabric to a desired location and then release the curtain fabric in opposite direction, the positioning member in the groove of the rotor will be actuated in opposite direction in the groove of the rotor, and the positioning member is engaged in a snap-fit point such that the rotor is locked and is unable to rotate. Furthermore, the winding rod is thus also locked so that the curtain fabric rolled on the winding rod can be fixed at the desired range of rolling or unrolling. However, the rotor of the conventional stroke setting device only has a single groove, and the snap-fit point in the groove only allows a slightly downward recess so as to maintain the smooth movement of the positioning member in the groove, thus the positioning member often fails to be locked effectively in position. On the other hand, if the recessed depth at the snap-fit point is enlarged, the positioning member might be unable to escape from the snap-fit point so that effect of controlling the positioning of the curtain fabric in rolling or unrolling might become worse. Moreover, this conventional device still needs the assistance of torsion spring, which will push cost upward. Hence, there is still rooms for further improvement.

SUMMARY OF THE INVENTION

The main object of the present invention is to provide a curtain control device which can lock the opening range of curtain fabric in rolling or unrolling, and slow down the roll-up speed of each part of the curtain, so as to reduce effectively the noise produced by the quick actuation of each part and the defective rate.

In order to achieve above objects, the inventor of the present invention proposes a curtain control device which mainly has a stroke setting device and a damper respectively assembled at both ends of a curtain spindle rod. A torsion element is further assembled on the curtain spindle rod. A curtain spindle sleeve is invaginated on the outside of the curtain spindle rod, the stroke setting device and the damper. The curtain spindle sleeve is assembled with the combination of the curtain spindle rod and the damper, and then a curtain fabric is assembled on the outside of the curtain spindle sleeve.

In this manner, the opening range of the curtain fabric roll can be controlled by the stoke setting device by providing a stroke setting device and a damper assembled respectively on both ends of the curtain spindle rod, and the roll-up speed of each part of the curtain is slowed down by the damper so as to reduce effectively the noise produced by the quick actuation of each part and the defective rate.

DETAILED DESCRIPTION OF PREFERRED EMBODIMENT

The objects, the technical contents and the expected effectiveness of the present invention will become more apparent from the detailed description of the preferred embodiment in conjunction with the accompanying drawings.

Figure 1:
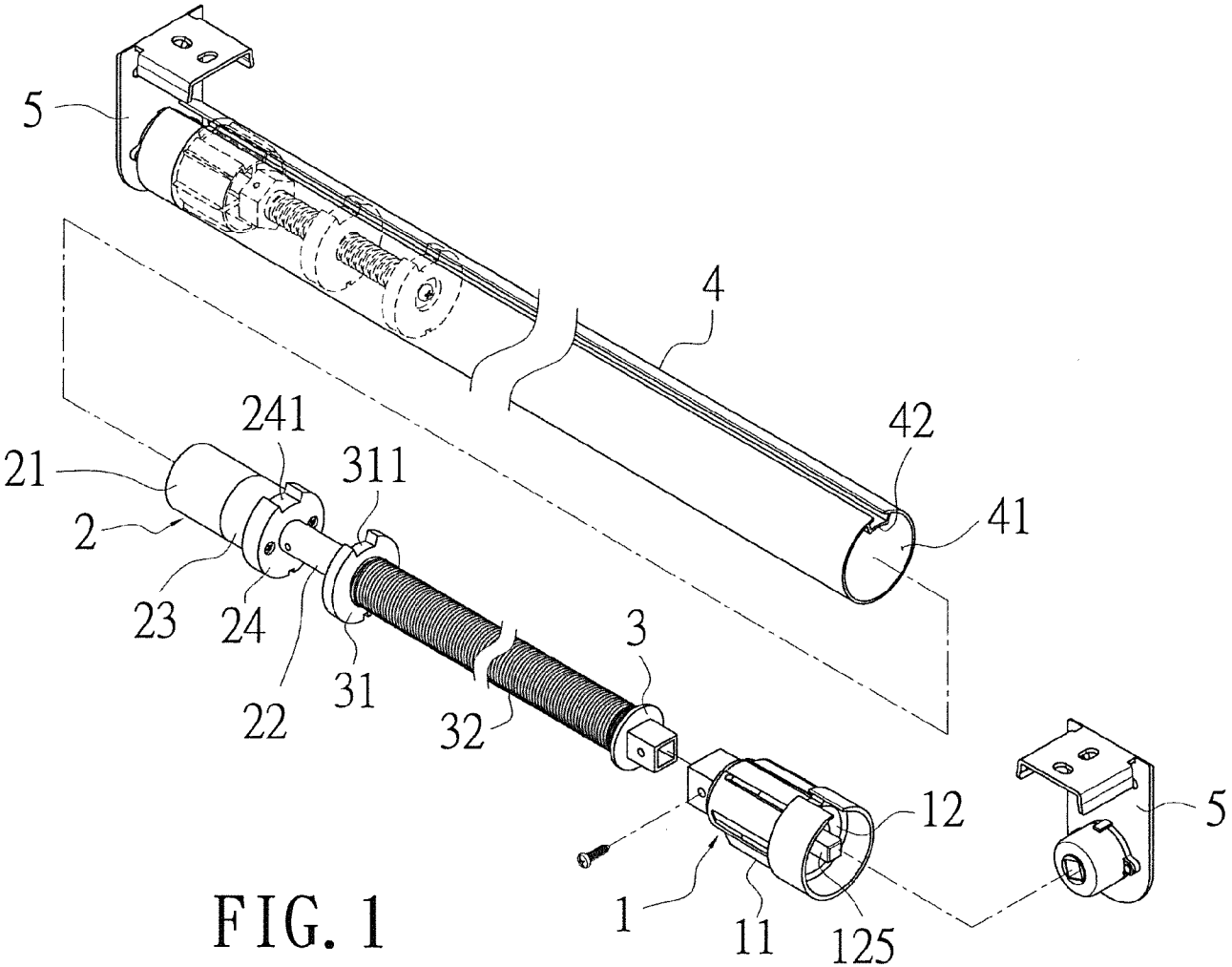
FIG. 1 is a perspective exploded view showing the whole of the present invention.
Figure 2:
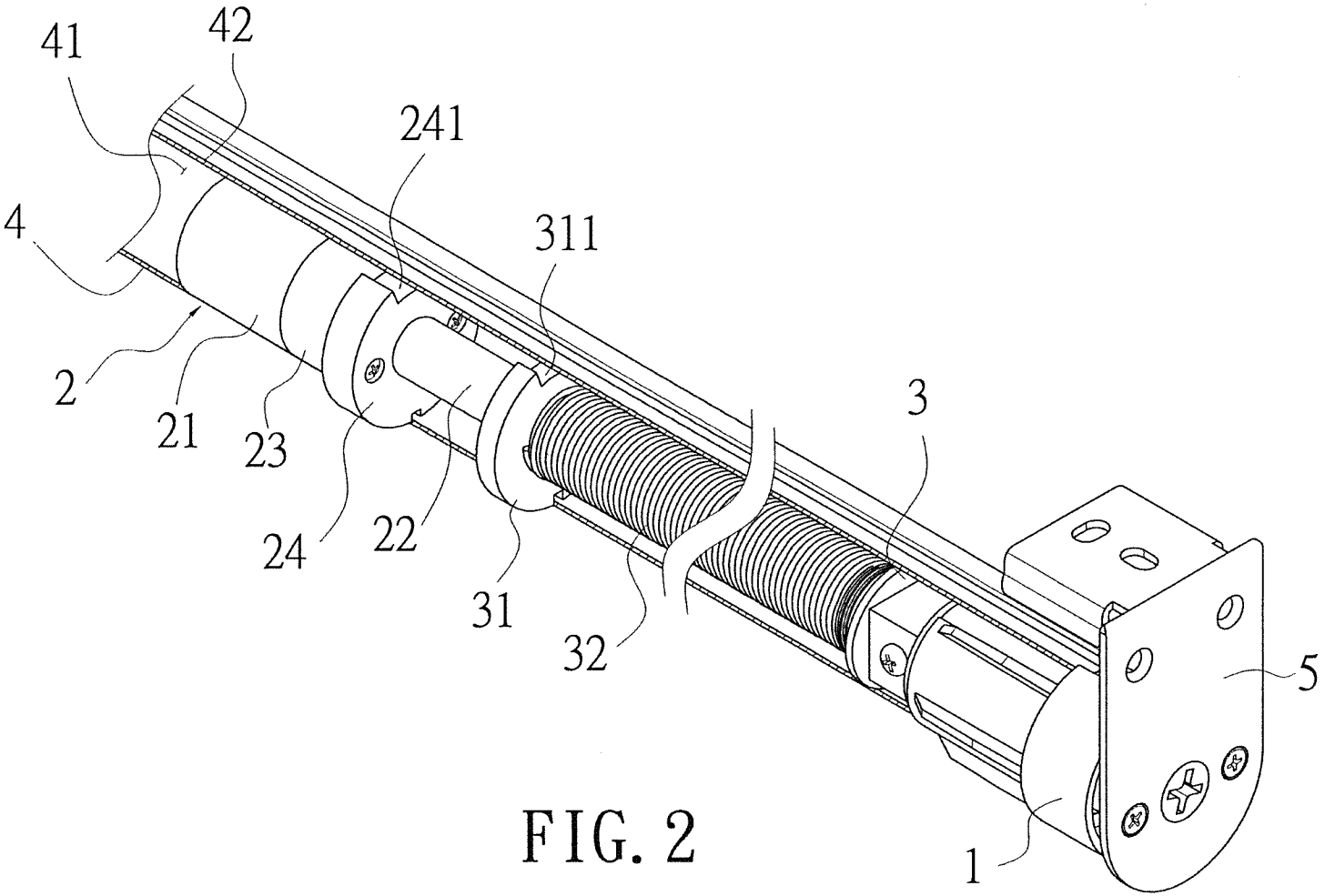
FIG. 2 a perspective sectional view showing the entirety of the present invention.

Firstly referring to FIGS. 1 and 2, the curtain control device of the present invention is mainly constituted of a stroke setting device (1), a damper (2), a curtain spindle rod (3) and a curtain spindle sleeve (4).

Figure 3:
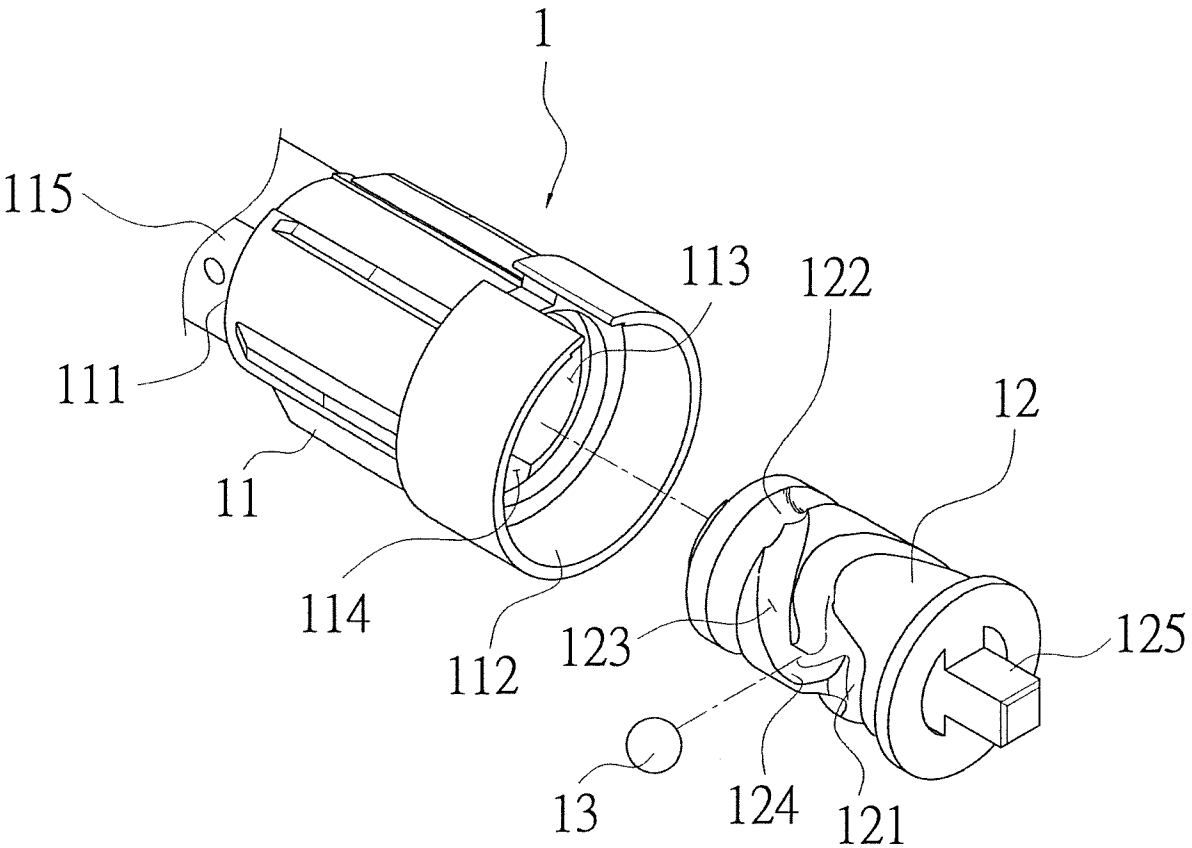
FIG. 3 is a perspective exploded view showing the stroke setting device of the present invention.
Figure 4:
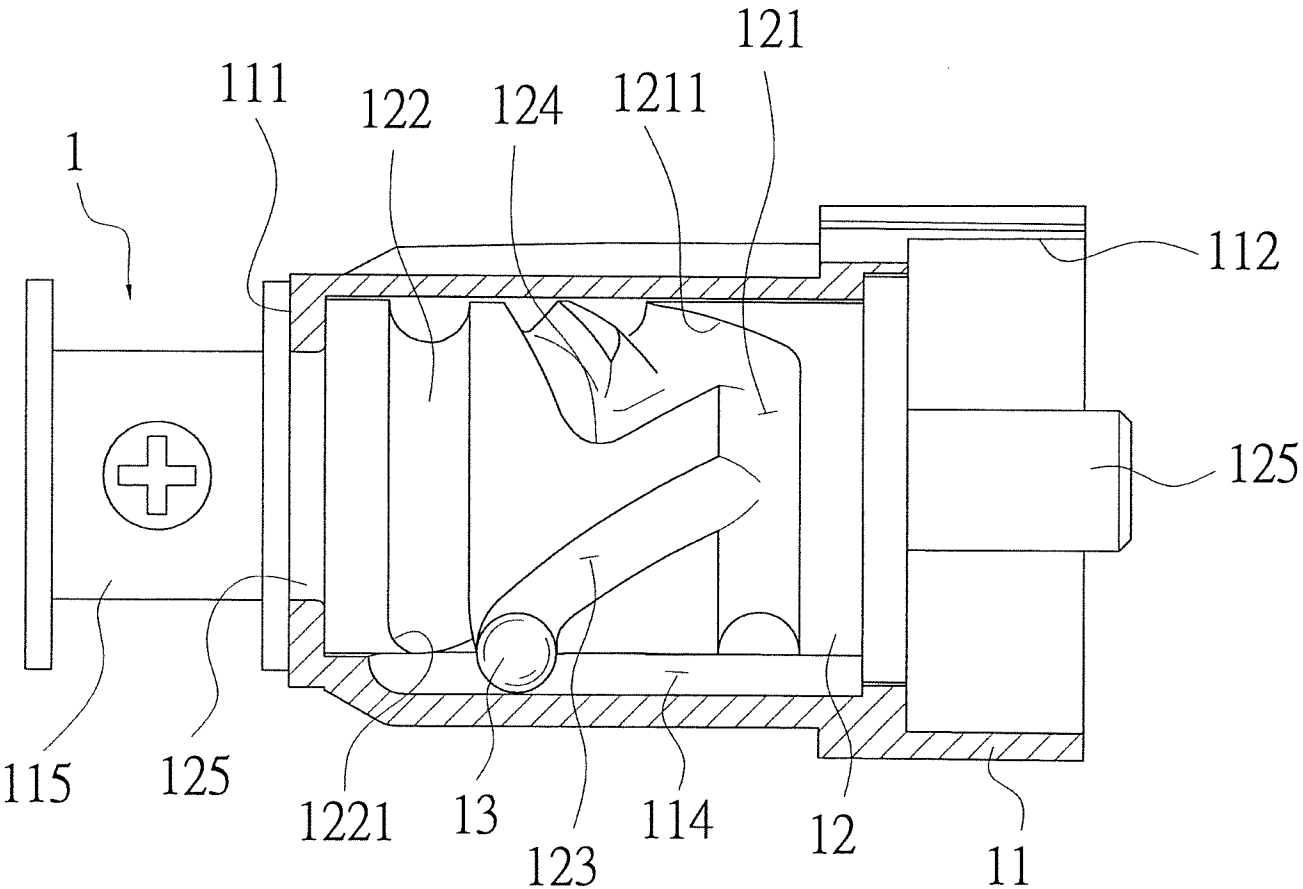
FIG. 4 is a sectional view showing the stroke setting device of the present invention.
Figure 5:
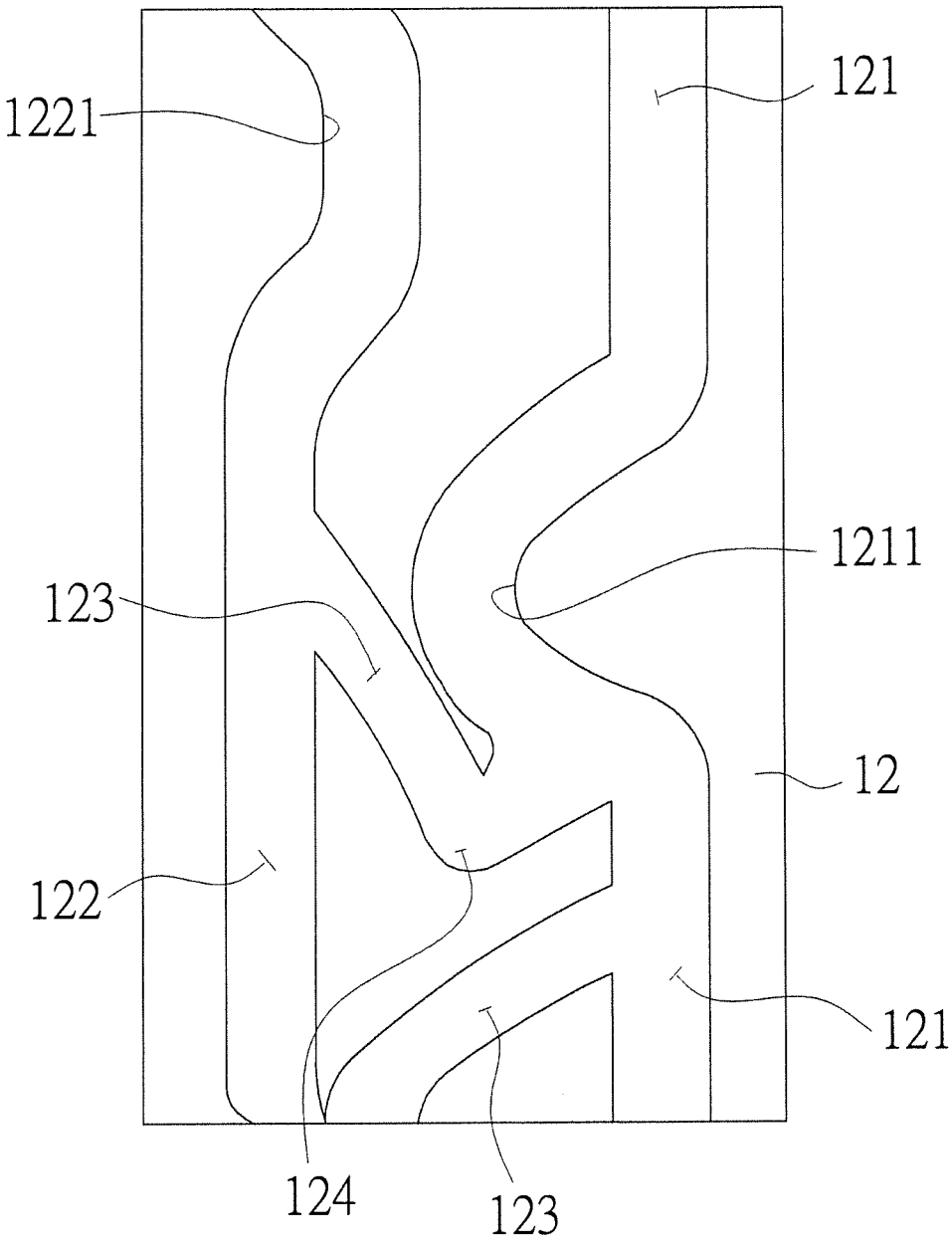
FIG. 5 is a developed diagram of the rotor of the present invention.

Referring to FIGS. 3 to 5, the stroke setting device (1) comprises a major body (11), a rotor (12) and a ball (13). The major body (11) of the stroke setting device (1) is a structure having a closed end (111) at one end, an opened end (112) at the other end, and a hollow portion (113) in its interior. A guiding groove (114) disposed along axial direction is provided on the inner wall of the hollow portion (113). An assembly portion (115) is provided on the closed end (111) of the major body (11) of the stroke setting device (1). Further, the rotor (12), having a first and a second grooves (121), (122) provided on two end edges opposite to each other and encircling the peripheral wall of the rotor (12) is assembled in the hollow portion (113) of the major body (11) of the stroke setting device (1). The first groove (121) provided on one end edge of the rotor (12) is formed as a curved segment (1211) facing towards the inside of the rotor (12) in the middle segment thereof. The second groove (122) is provided to be staggered with respect to the first groove (121), and two connection grooves (123) separated with each other are provided between the first and the second grooves (121), (122)

for the communication therebetween. One of the two connection grooves (123) has an engagement recess (124) depressed downward which is made to be connected to the joint of the first groove (121) and the curved segment (1211), while the other connection groove (123) is connected to the first groove (121) through a turning segment (1221) of the second groove (122). Then, the ball (13) can be placed in the guiding groove (114) of the major body (11) of the stroke setting device (1), or the first and the second grooves (121), (122) and the connection groove (123) of the rotor (12). Two joint sections (125) are respectively formed on the two ends of the rotor (12), one of which is assembled with the assembly portion (115) of the major body (11) of the stroke setting device (1).

Figure 6:
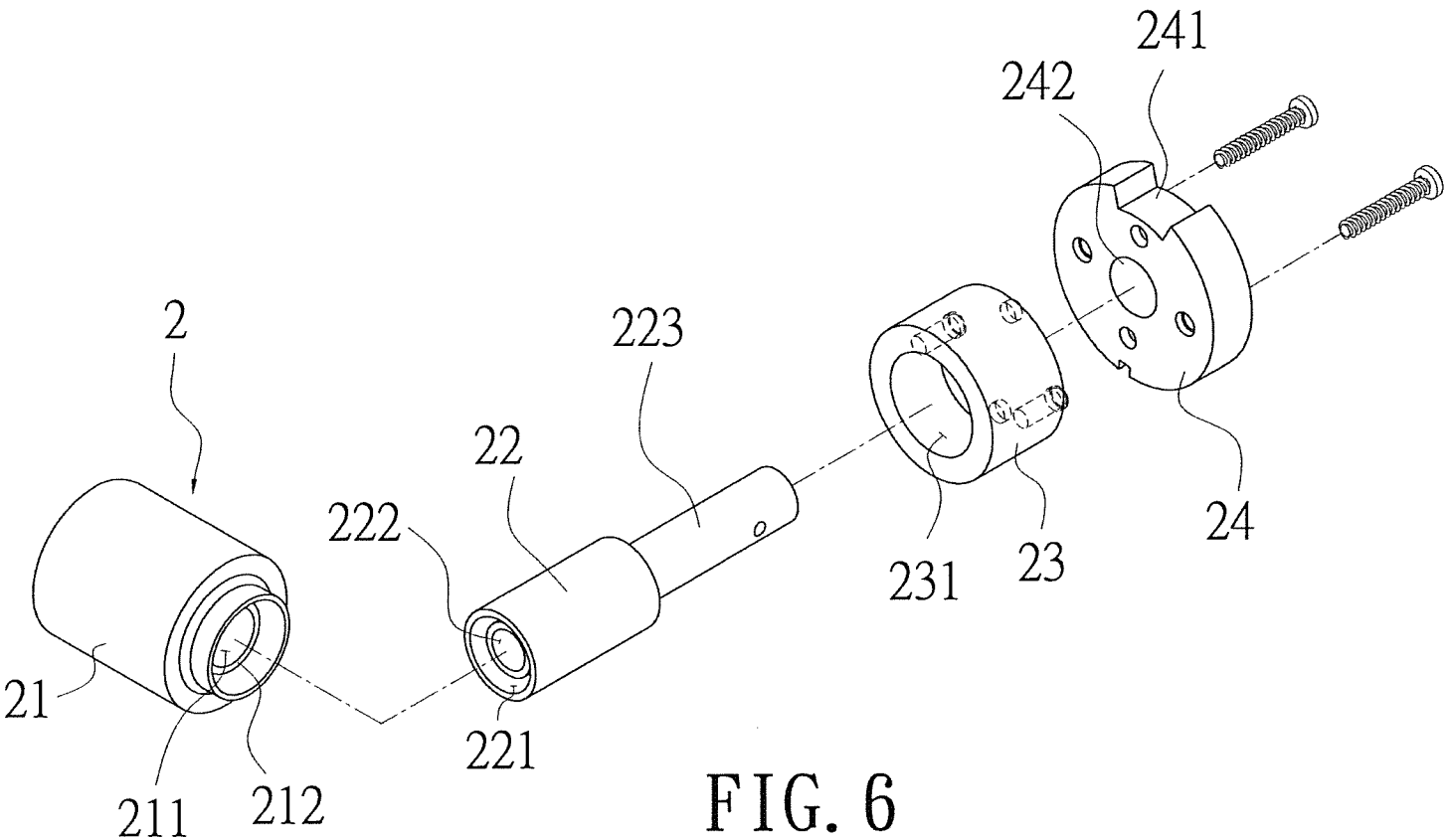
FIG. 6 is a perspective exploded view showing the damper of the present invention.
Figure 7:
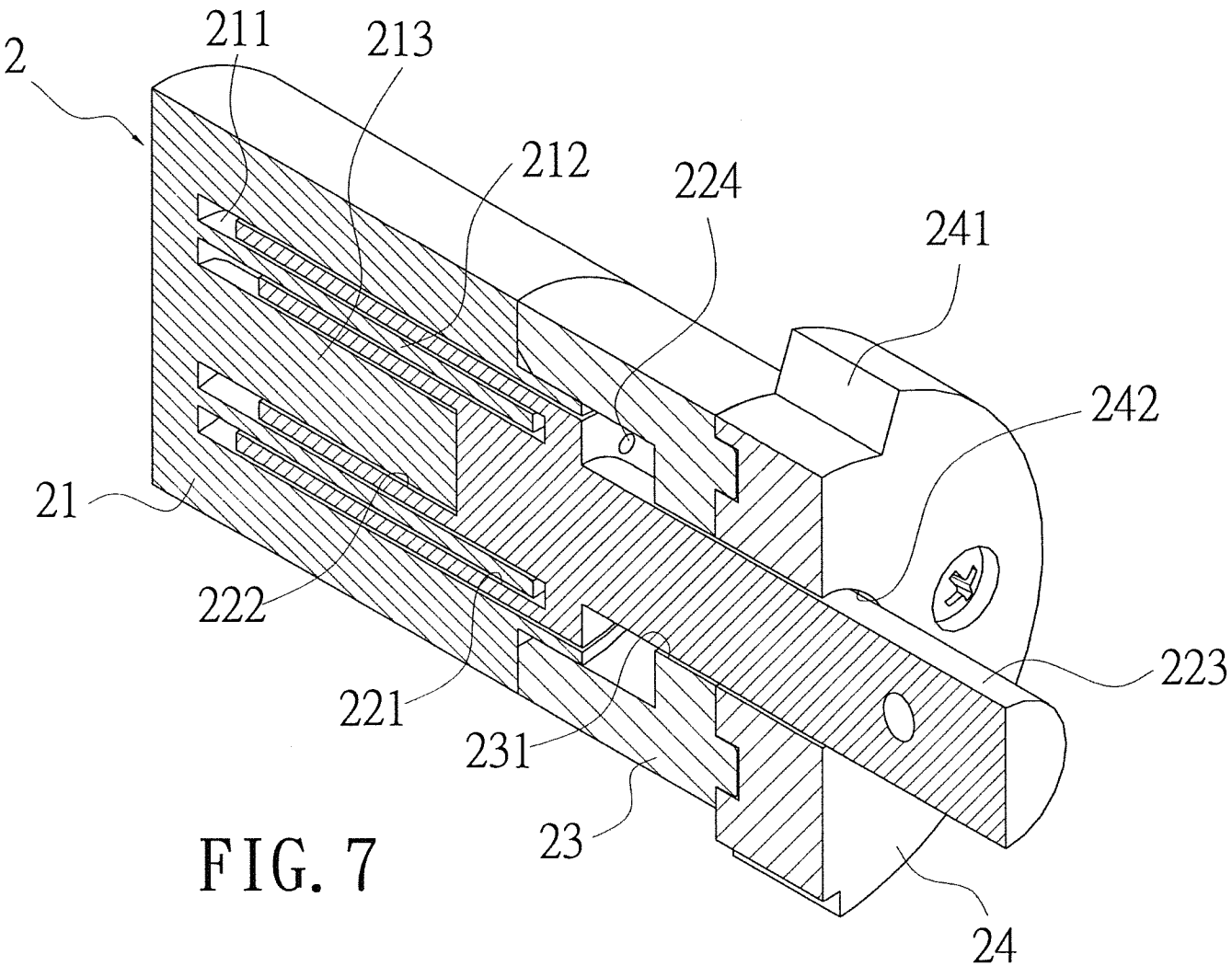
FIG. 7 is a perspective sectional view showing the damper of the present invention.
Figure 8:
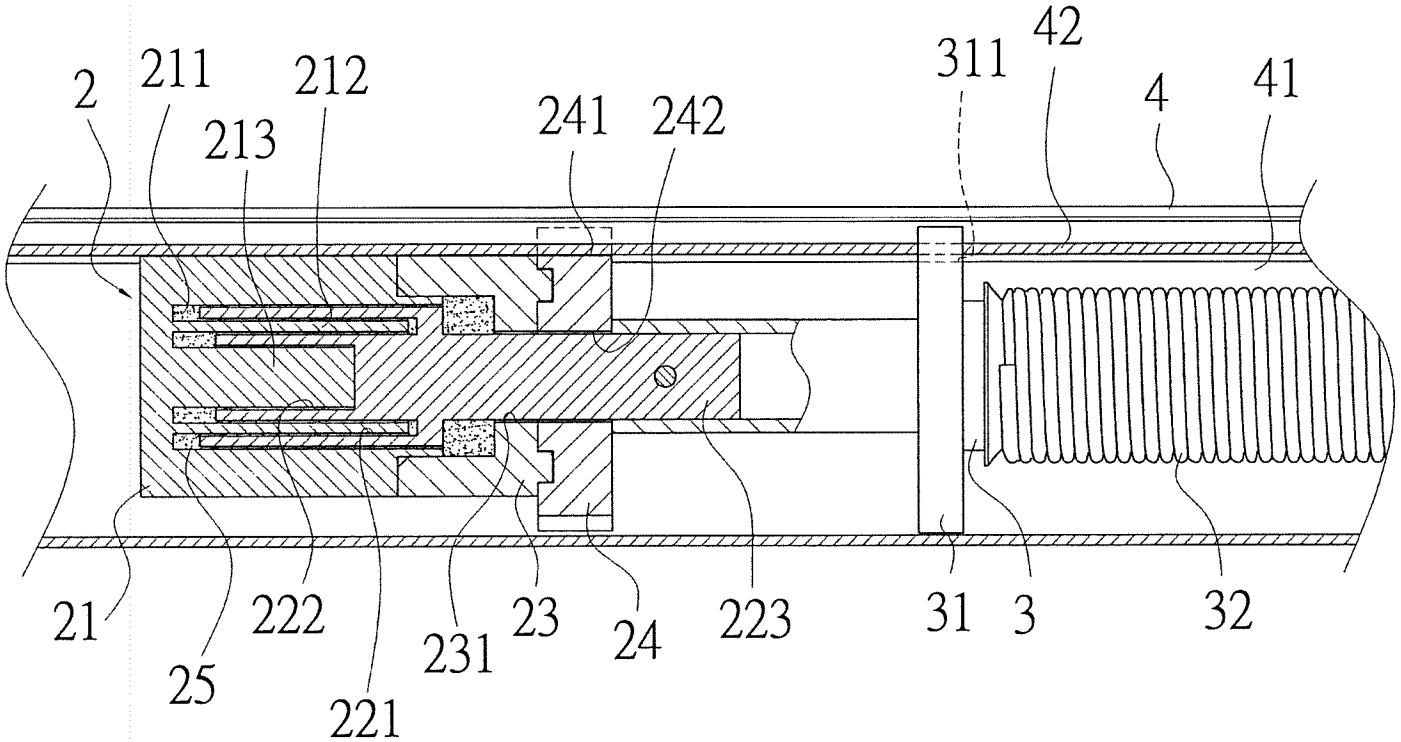
FIG. 8 is a sectional view showing the damper of the present invention.

Referring to FIGS. 6 to 8, the damper (2) has a damper main body (21) which is formed with an accommodation portion (211) at its one end. A support shaft (22) is provided in the accommodation portion (211), and one end of the support shaft (22) and the accommodation portion (211) of the damper main body (21) are respectively formed with a first trough portion (221) and a first invagination portion (212) mating with each other. Furthermore, a second trough portion (222) is provided at the center of the support shaft (22), and a second invagination portion (213) for invaginating in the second trough portion (222) is formed in the inside of the first invagination portion (212). A rod body (223) is provided to project at the other end of the support shaft (22), and an end cap (23) is attached to a place on the damper main body (21) corresponding to the opening of the accommodation portion (211). A through hole (231) is provided at the center of the end cap (23) for the penetration out of the rod body (223) of the support shaft (22). Further, a combination member (24) is assembled at the other end of the end cap (23) opposite to the end attached with the damper main body (21), a female snap-fit portion (241) being provided on the peripheral edge of the combination member (24). A through hole (242) is provided on the combination member (24) for the penetration of the rod body (223) of the support shaft (22). Then, damping material (25), being a viscous oil, is provided between the first trough portion (221) of the support shaft (22) and the first invagination portion (212) of the damper main body (21), and between the second trough portion (222) and the second invagination portion (213); further, a plurality of perforation (224) is provided on the end of the support shaft (22) with projection of the rod body (223) for supplying liquid damping material (25) to flow between the end cap (23) and the rod body (223) of the support shaft (22).

The curtain spindle rod (3) is provided between the stroke setting device (1) and the damper (2), one end of the curtain spindle rod (3) being assembled with the assembly portion (115) provided on the major body (11) of the stroke setting device (1) and the other end with the rod body (223) of the support shaft (22) of the damper (2). A combination member (31) is fixed to the curtain spindle rod (3), and a female snap-fit portion (311) is provided on the peripheral edge of the combination member (31). A torsion element (32) is also assembled on the curtain spindle rod (3).

The curtain spindle sleeve (4) has a hollow bore (41) for housing the stroke setting device (1), the damper (2) and the curtain spindle rod (3), the inner wall of the hollow bore (41) having a male snap-fit portion (42) for engaging with the corresponding female snap-fit portion (241), (311) respectively provided on the damper (2) and the curtain spindle rod (3).

Figure 9:
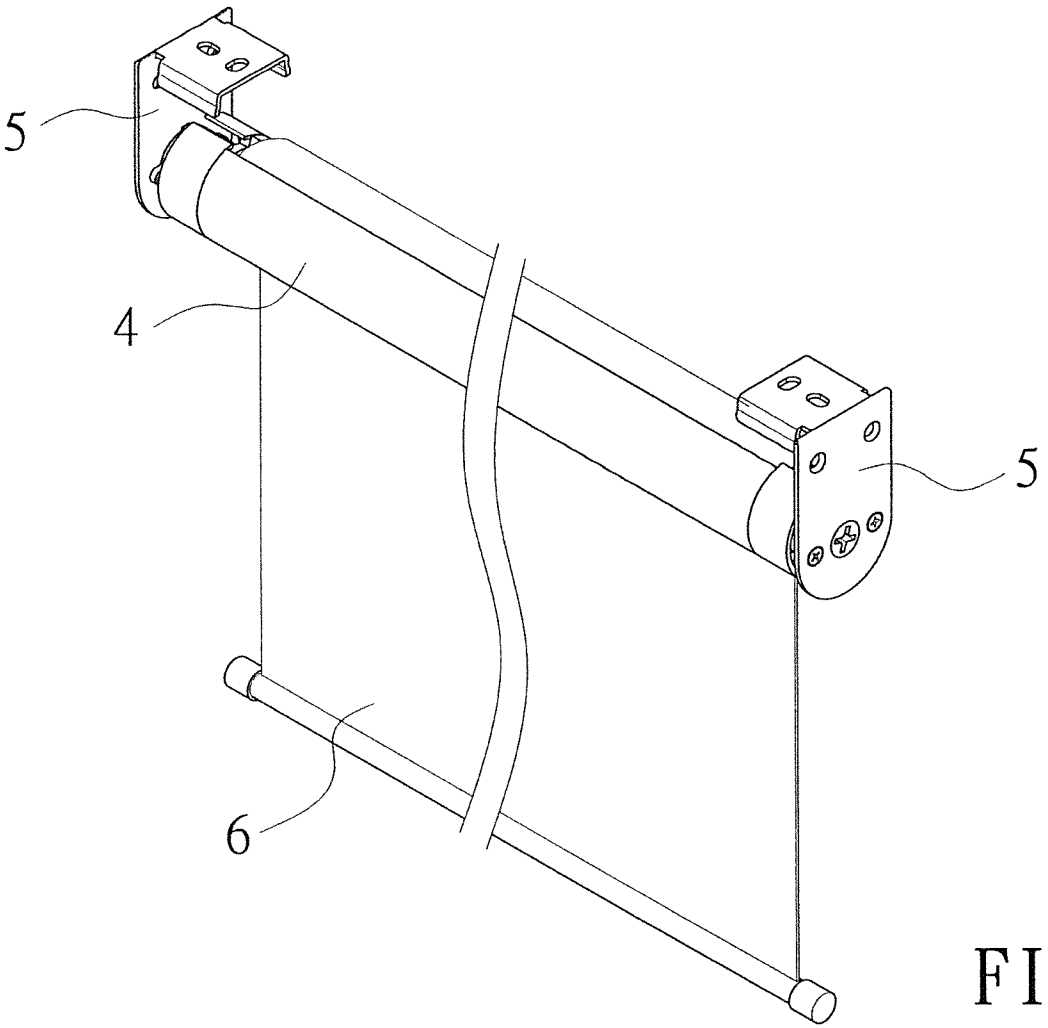
FIG. 9 is an assembly view showing the whole of the present invention.

Configuring in the manner, when assembly is implemented, referring to FIGS. 1, 2 and 9, the joint section (125) on one end of the rotor (12) is assembled with the assembly portion (115) of the major body (11) of the stroke setting device (1); then the assembly portion (115) of the major body (11) of the stroke setting device (1) is assembled with the curtain spindle rod (3); next, the other end of the curtain spindle rod (3) is connected with the rod body (223) of the support shaft (22) of the damper (2); furthermore, the joint section (125) exposed to the outside of the opened end (112) of the major body (11) of the stroke setting device (1) is connected with the curtain mounting frame (5); the curtain spindle sleeve (4) is invaginated on the outside of the stroke setting device (1), the damper (2), and the curtain spindle rod (3); the male snap-fit portion (42) of the curtain spindle sleeve (4) is engaged with the female snap-fit portion (241), (311) of the combination member (24), (31) provided respectively on the damper (2) and the curtain spindle rod (3); finally, the curtain fabric (6) is assembled on the curtain spindle sleeve (4).

Figure 10:
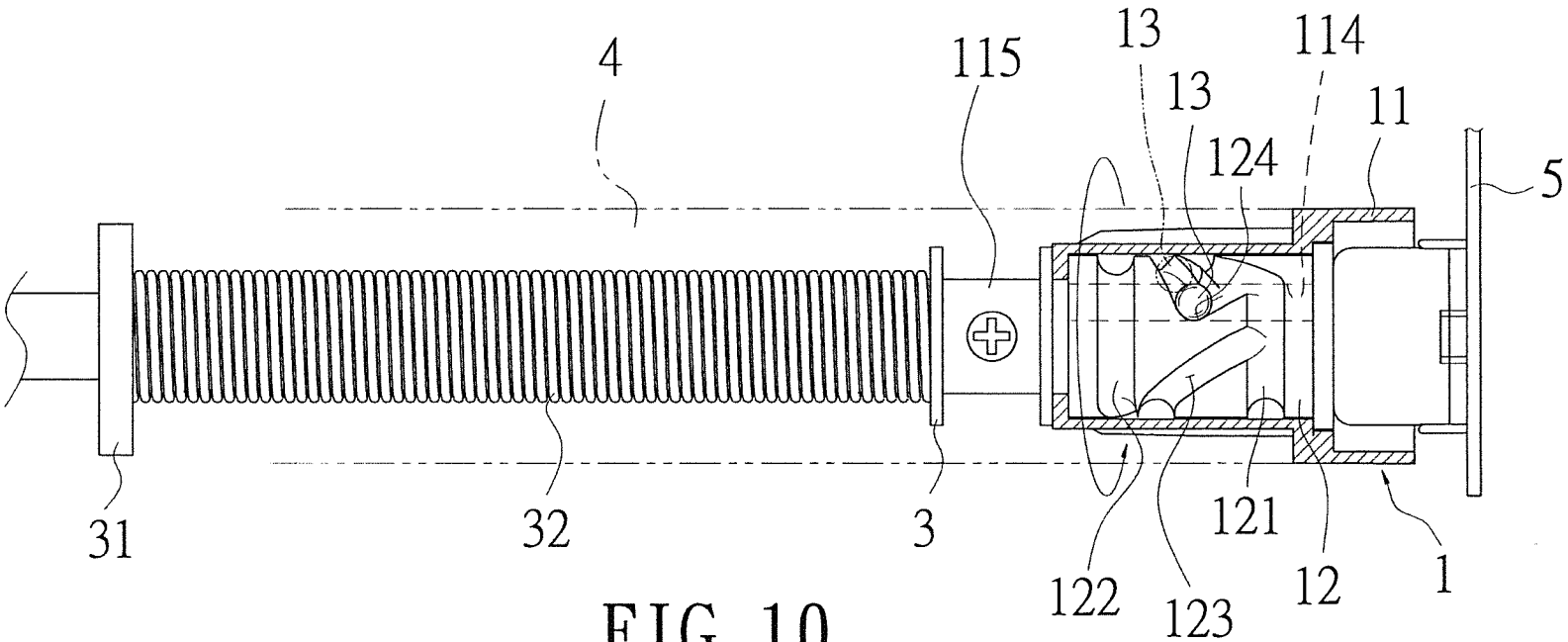
FIG. 10 is a view showing the release of engagement state of the stroke setting device of the present invention.
Figure 11:
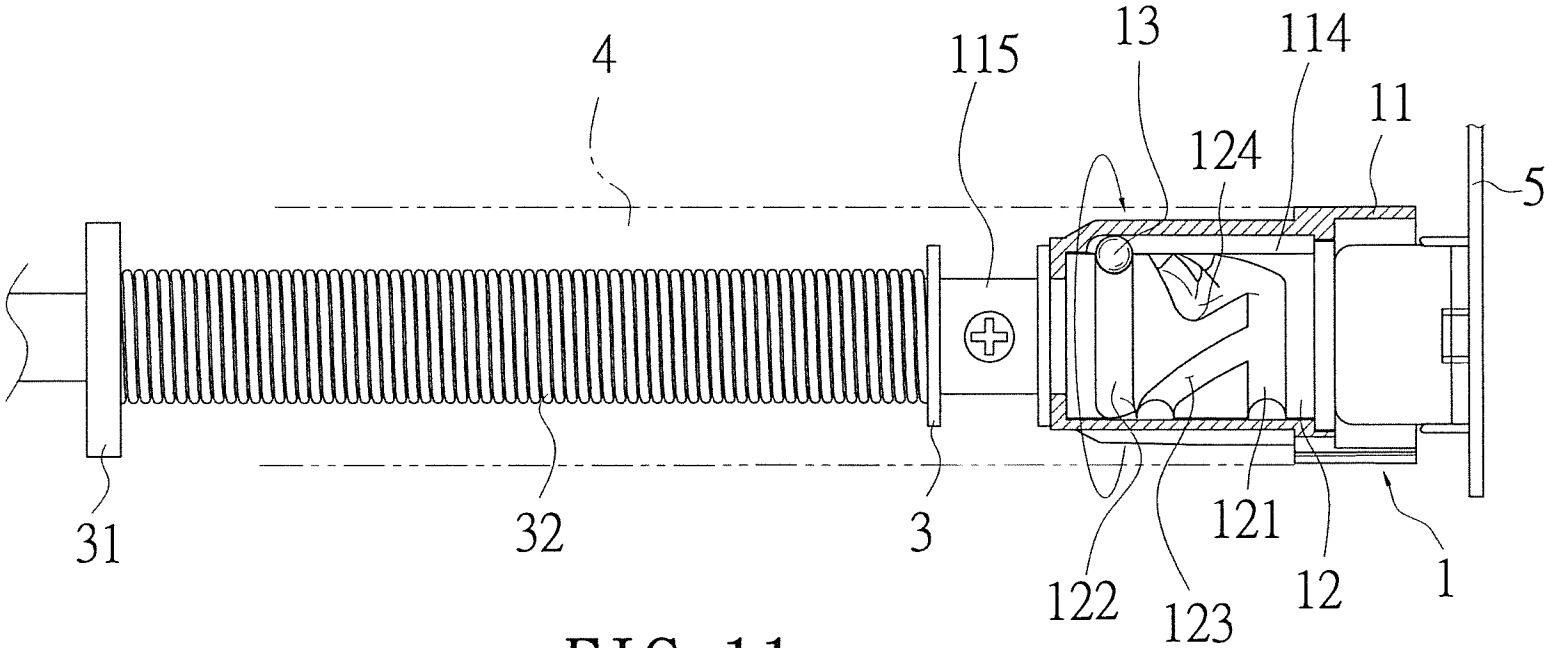
FIG. 11 is a view showing the state of rolling up of the curtain spindle rod of the present invention.

Configuring like this, referring to FIG. 10, when user want to roll up the curtain fabric (6), the curtain fabric (6) is firstly pulled down and is released immediately so that the curtain fabric (6) drives the curtain spindle sleeve (4). Simultaneously, the curtain spindle rod (3) and the major body (11) of the stroke setting device (1) linked with the curtain spindle sleeve (4) are rotated. At this moment, the ball (13) provided between the major body (11) of the stroke setting device (1) and the rotor (12) escapes from the engagement recess (124). Referring to FIG. 11, when user lets go his hand from the curtain, a torsion element (32), which is assembled on the curtain spindle rod (3) and is subjected to twisting so as to store elastic force therein, releases its torsional force to recover to original shape after losing the engagement of the ball (13), so as to actuate the curtain spindle rod (3) to rotate in opposite direction, and then the curtain spindle rod (3) drives the major body (11) of the stroke setting device (1) to rotate.

At this moment, the ball (13) disposed between the major body (11) of the stroke setting device (1) and the rotor (12) will drop randomly into the first groove (121) or the second groove (122) and is guided in the guiding groove (114) of the major body (11) of the stroke setting device (1) to move smoothly along the first groove (121) or the second groove (122) in such a manner that the curtain fabric (6) is wound on the curtain spindle sleeve (4) to achieve the roll-up effect of the curtain fabric (6).

Further referring to FIG. 8, when the curtain spindle sleeve (4) drives the curtain fabric (6) to roll up, the combination member (24) of the damper (2) engaged with the curtain spindle sleeve (4) will drive the end cap (23) attached therewith and the damper main body (21) coupled with the end cap (23) to rotate. At this moment, the viscous damping material (25) provided between the first trough portion (221) of the support shaft (22) and the first invagination portion (212) of the damper main body (21), and between the second trough portion (222) and the second invagination portion (213) will slow down the quick rotation speed, by means of its viscous force, of the curtain spindle sleeve (4) caused by the recovering of the torsion element (32) from twisted state back to original state, so as to lower down the defective rate of each part produced due to quick roll-up action and noise generated.

Figure 12:
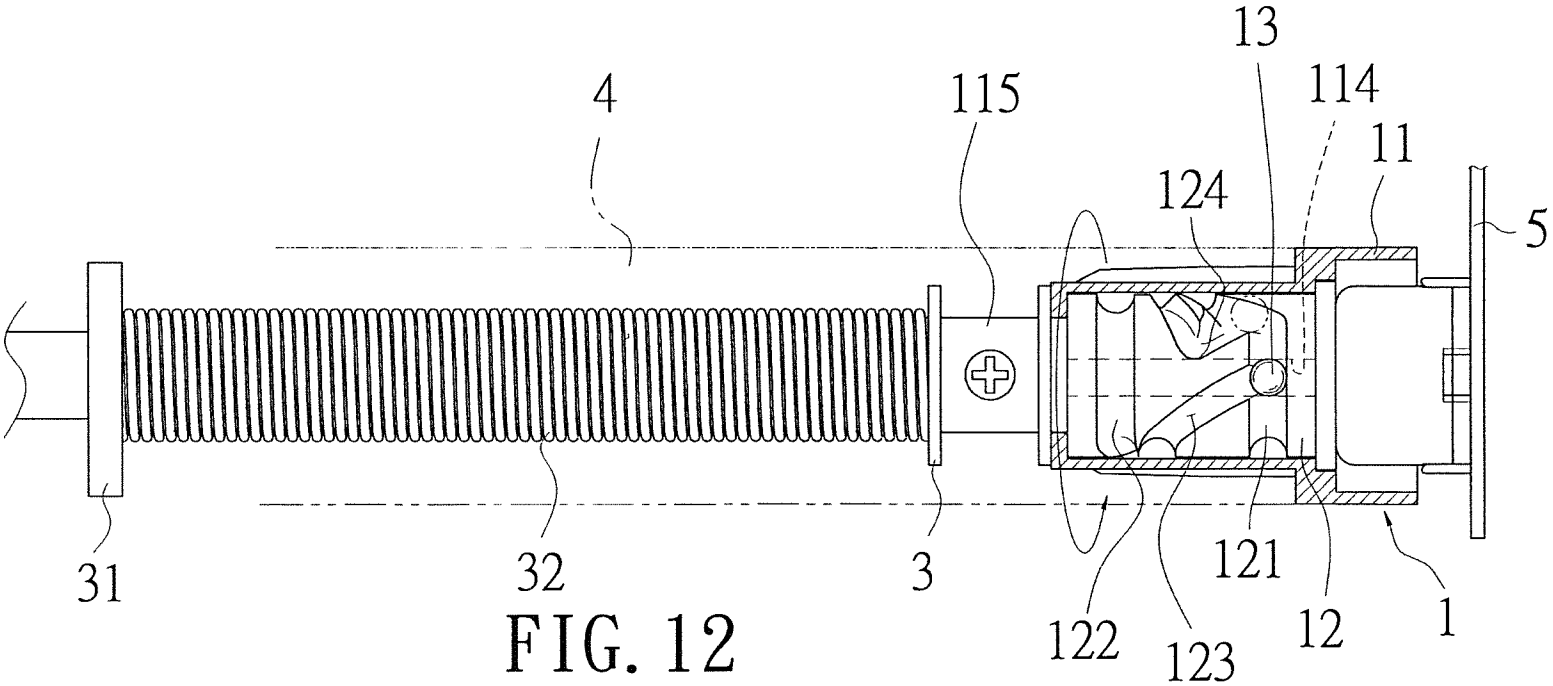
FIG. 12 is a view showing the state of unrolling of the curtain spindle rod of the present invention.
Figure 13:
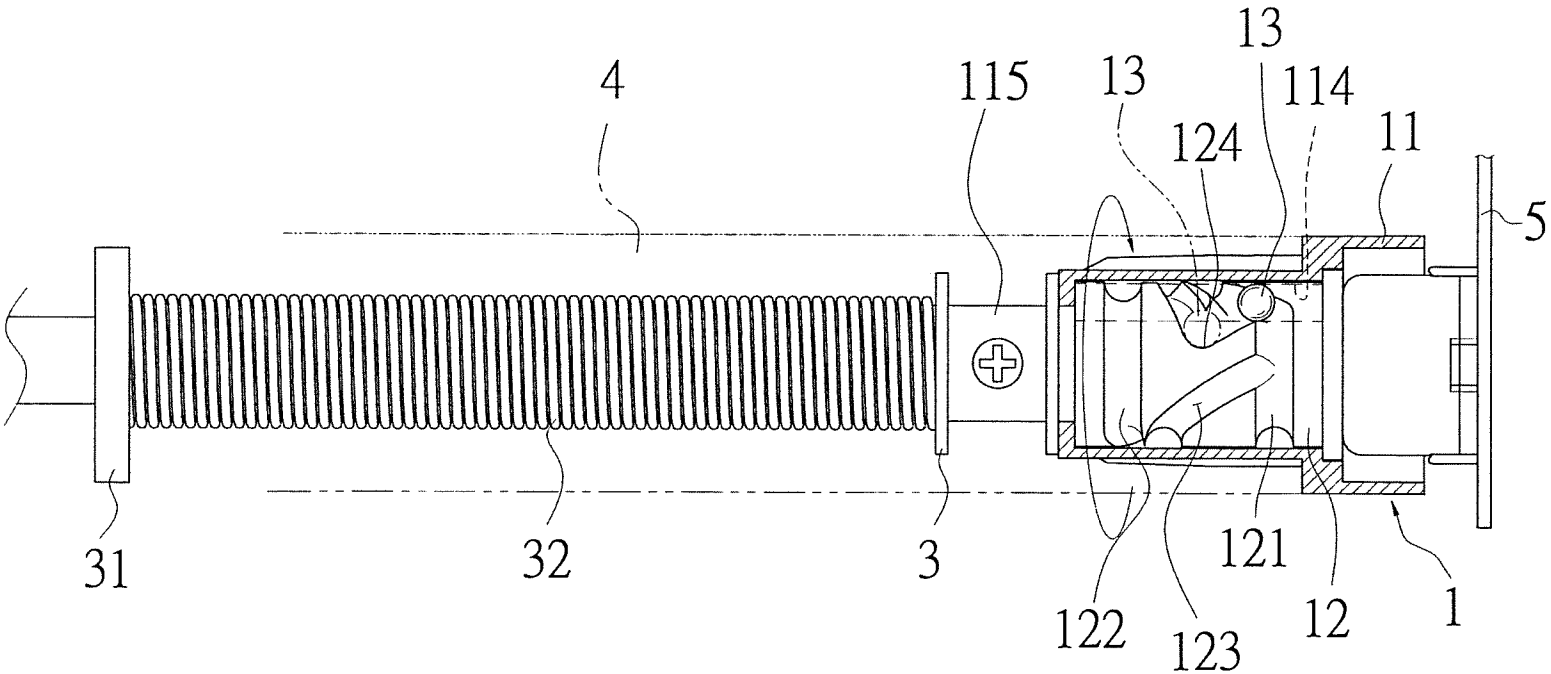
FIG. 13 is a view showing the locking state of unrolling of the curtain spindle rod of the present invention.

Further referring to FIG. 12, when user want to unroll the curtain fabric (6) to a desired position, the curtain fabric (6) is continuously pulled down. At this moment, the curtain fabric (6) drives the curtain spindle sleeve (4), and then drives the curtain spindle rod (3) connected therewith and the major body (11) of the stroke setting device (1) to rotate. The ball (13) positioned in the guiding groove (114) of the major body (11) of the stroke setting device (1) will be driven to move along the first or the second groove (121), (122) of the rotor (12) so that the major body (11) of the stroke setting device (1), the curtain spindle rod (3) and the curtain spindle sleeve (4) can be rotated smoothly to the desired unrolled position of the curtain fabric (6) by the driving come from the force for pulling down the curtain fabric (6). Next, the pull force on the curtain fabric (6) is again released. Referring to FIG. 13, when the curtain spindle rod (3) is rotated, the torsion element (32) assembled therewith produces twisting in positive direction due to the rotation of the curtain spindle rod (3). So when user releases the pull force on the curtain fabric (6), the torsion element (32) will recover to its original position in opposite direction so as to drive the major body (11) of the stoke setting device (1) connected with the curtain spindle rod (3) to rotate. Simultaneously, the ball (13) within the major body (11) of the stoke setting device (1) is driven to move in opposite direction along the first or the second groove (121), (122) of the rotor (12), and drops into the engagement recess (124) of the connection groove (123) so as to lock the major body (11) of the stoke setting device (1) and then the curtain spindle rod (3) connected therewith and the curtain spindle sleeve (4) in positions. Hence, the curtain fabric (6) is fixed at desired position.

What is claimed is:

1. A curtain control device, comprising:

a stroke setting device (1), having a major body (11), a guiding groove (114) disposed along axial direction being provided on the inner wall of a hollow portion (113) of said major body (11); a rotor (12) being mounted within said hollow portion (113) of said major body (11); a first and a second grooves (121), (122) opposite to each other being provided on two end edges and encircling the peripheral wall of said rotor (12); two connection grooves (123) separated with each other being provided between said first and said second grooves (121), (122) for the communication therebetween, one of said two connection grooves (123) having an engagement recess (124) depressed downward; and a ball (13), which may be located in said first, said second and said connection grooves (121), (122), (123), and said ball (13) being provided in said guiding groove (114) of said major body (11) of said stroke setting device (1);

a damper (2), having a damper main body (21) which is formed with an accommodation portion (211) on its one end; a support shaft (22) being provided in said accommodation portion (211); damping material (25) being provided between said support shaft (22) and said damper main body (21); an end cap (23) being attached to a place on said damper main body (21) corresponding to the opening of said accommodation portion (211); a through hole (231) being provided at the center of said end cap (23) for the penetration out of a rod body (223) of said support shaft (22); further, a combination member (24) being assembled at the other end of said end cap (23) opposite to the end attached to said damper main body (21);

a curtain spindle rod (3), which is provided between said stroke setting device (1) and said damper (2), having one end thereof assembled with said major body (11) of said stroke setting device (1), and the other end with said rod body (223) of said support shaft (22) of the damper (2); a combination member (31) being attached to said curtain spindle rod (3); and a torsion element (32) being also assembled on said curtain spindle rod (3); and a curtain spindle sleeve (4), having a hollow bore (41) for housing said stroke setting device (1), said damper (2) and said curtain spindle rod (3); said combination members (24), (31) of said damper (2) and said curtain spindle rod (3) being assembled with said curtain spindle sleeve (4);

wherein said first groove (121) provided on one end edge of said rotor (12) of said stoke setting device (1) has the middle segment thereof to be formed as a curved segment (1211) facing towards the inside of said rotor (12);

wherein one of said two connection grooves (123) of said rotor (12) is made to be connected to the joint of said first groove (121) and said curved segment (1211);

wherein said stroke setting device (1) is further formed with a turning segment (1221) on said second groove (122) of said rotor (12), and the other connection groove (123) is connected to said first groove (121) through said turning segment (1221) of said second groove (122); and wherein said damper (2) further has a trough portion and an invagination portion mating with each other, for accommodating damping material (25) therein, provided between said support shaft (22) and said accommodation portion (211) of said damper main body (21).

2. The curtain control device as claimed in claim 1, wherein said stroke setting device (1) is further formed with a turning segment (1221) on said second groove (122) of said rotor (12), and the other connection groove (123) is connected to said first groove (121) through said turning segment (1221) of said second groove (122).

3. The curtain control device as claimed in claim 1, wherein said damper (2) and the curtain spindle rod (3) have female snap-fit portions (241), (311) respectively provided on the peripheral edges of said combination member (24), (31) thereof, and a male snap-fit portion (42) for engaging with said female snap-fit portions (241), (311) is provided on the inner wall of said hollow bore (41).

4. The curtain control device as claimed in claim 1, wherein said major body (11) of said stroke setting device (1) is a structure having a closed end (111) at one end, an opened end (112) at the other end, and a hollow portion (113) in its interior; an assembly portion (115) being provided on said closed end (111) of said major body (11) of said stroke setting device (1); two joint sections (125) being respectively formed on the ends of said rotor (12) so as to correspond to said opened end (112) and said assembly portion (115) of said closed end (111).

5. The curtain control device as claimed in claim 1, wherein said damper (2) further has a trough portion and an invagination portion mating with each other, for accommodating damping material (25) therein, provided between said support shaft (22) and said accommodation portion (211) of said damper main body (21).

6. The curtain control device as claimed in claim 1, wherein a plurality of perforation (224) is further provided on the end face of said support shaft (22), having projection of said rod body (223) therewith, for supplying damping material (25) to flow between said end cap (23) and said rod body (223) of said support shaft (22).

7. A curtain control device, comprising:

a stroke setting device (1), having a major body (11), a guiding groove (114) disposed along axial direction being provided on the inner wall of a hollow portion (113) of said major body (11); a rotor (12) being mounted within said hollow portion (113) of said major body (11); a first and a second grooves (121), (122) opposite to each other being provided on two end edges and encircling the peripheral wall of said rotor (12); two connection grooves (123) separated with each other being provided between said first and said second grooves (121), (122) for the communication therebetween, one of said two connection grooves (123) having an engagement recess (124) depressed downward; and a ball (13), which may be located in said first, said second and said connection grooves (121), (122), (123), and said ball (13) being provided in said guiding groove (114) of said major body (11) of said stroke setting device (1);

a damper (2), having a damper main body (21) which is formed with an accommodation portion (211) on its one end; a support shaft (22) being provided in said accommodation portion (211); damping material (25) being provided between said support shaft (22) and said damper main body (21); an end cap (23) being attached to a place on said damper main body (21) corresponding to the opening of said accommodation portion (211); a through hole (231) being provided at the center of said end cap (23) for the penetration out of a rod body (223) of said support shaft (22); further, a combination member (24) being assembled at the other end of said end cap (23) opposite to the end attached to said damper main body (21); said damper (2) further having a trough portion and an invagination portion mating with each other, for accommodating damping material (25) therein, provided between said support shaft (22) and said accommodation portion (211) of said damper main body (21);

a curtain spindle rod (3), which is provided between said stroke setting device (1) and said damper (2), having one end thereof assembled with said major body (11) of said stroke setting device (1), and the other end with said rod body (223) of said support shaft (22) of the damper (2); a combination member (31) being attached to said curtain spindle rod (3); and a torsion element (32) being also assembled on said curtain spindle rod (3); and a curtain spindle sleeve (4), having a hollow bore (41) for housing said stroke setting device (1), said damper (2) and said curtain spindle rod (3); said combination members (24), (31) of said damper (2) and said curtain spindle rod (3) being assembled with said curtain spindle sleeve (4).

8. A curtain control device, comprising:

a stroke setting device (1), having a major body (11), a guiding groove (114) disposed along axial direction being provided on the inner wall of a hollow portion (113) of said major body (11); a rotor (12) being mounted within said hollow portion (113) of said major body (11); a first and a second grooves (121), (122) opposite to each other being provided on two end edges and encircling the peripheral wall of said rotor (12); two connection grooves (123) separated with each other being provided between said first and said second grooves (121), (122) for the communication therebetween, one of said two connection grooves (123) having an engagement recess (124) depressed downward; and a ball (13), which may be located in said first, said second and said connection grooves (121), (122), (123), and said ball (13) being provided in said guiding groove (114) of said major body (11) of said stroke setting device (1);

a damper (2), having a damper main body (21) which is formed with an accommodation portion (211) on its one end; a support shaft (22) being provided in said accommodation portion (211); damping material (25) being provided between said support shaft (22) and said damper main body (21); an end cap (23) being attached to a place on said damper main body (21) corresponding to the opening of said accommodation portion (211); a through hole (231) being provided at the center of said end cap (23) for the penetration out of a rod body (223) of said support shaft (22); further, a combination member (24) being assembled at the other end of said end cap (23) opposite to the end attached to said damper main body (21);

a curtain spindle rod (3), which is provided between said stroke setting device (1) and said damper (2), having one end thereof assembled with said major body (11) of said stroke setting device (1), and the other end with said rod body (223) of said support shaft (22) of the damper (2); a combination member (31) being attached to said curtain spindle rod (3); and a torsion element (32) being also assembled on said curtain spindle rod (3); and a curtain spindle sleeve (4), having a hollow bore (41) for housing said stroke setting device (1), said damper (2) and said curtain spindle rod (3); said combination members (24), (31) of said damper (2) and said curtain spindle rod (3) being assembled with said curtain spindle sleeve (4);

wherein a plurality of perforation (224) is further provided on the end face of said support shaft (22), having projection of said rod body (223) therewith, for supplying damping material (25) to flow between said end cap (23) and said rod body (223) of said support shaft (22).

* * * * *